US007597460B1

(12) United States Patent
Rashidi

(10) Patent No.: US 7,597,460 B1
(45) Date of Patent: Oct. 6, 2009

(54) TRI-BAFFLE CEILING FIXTURE REFLECTOR INCLUDING SNAPPER ASSEMBLY

(76) Inventor: Hamid Rashidi, 139 N. Clark Dr., Beverly Hills, CA (US) 90211

( * ) Notice: Subject to any disclaimer, the term of this patent is extended or adjusted under 35 U.S.C. 154(b) by 77 days.

(21) Appl. No.: 11/504,137

(22) Filed: Aug. 14, 2006

(51) Int. Cl.
*F21V 7/10* (2006.01)
*F21V 17/10* (2006.01)

(52) U.S. Cl. ..... 362/348; 362/346; 362/350; 362/439; 362/453

(58) Field of Classification Search ..... 362/346, 362/348, 350, 439, 444, 452, 453
See application file for complete search history.

(56) References Cited

U.S. PATENT DOCUMENTS 4,399,497 A * 8/1983 Druffel ..... 362/444
4,754,377 A * 6/1988 Wenman ..... 362/364
5,673,997 A * 10/1997 Akiyama ..... 362/365
5,836,678 A * 11/1998 Wright et al. ..... 362/364
5,921,655 A * 7/1999 Nassim ..... 362/364
6,168,299 B1 * 1/2001 Yan ..... 362/365
6,217,189 B1 * 4/2001 Nassim ..... 362/365
6,425,680 B1 * 7/2002 Rippel et al. ..... 362/350

* cited by examiner

*Primary Examiner*—Ismael Negron
(74) *Attorney, Agent, or Firm*—Thomas I. Rozsa

(57) ABSTRACT

An improvement in lightbulb housings which is the addition of a third baffle that extends beyond and behind the length of a standard baffle which generally ends at the tip or beginning of a socket. By adding a third baffle that goes beyond and behind the socket, a snapper assembly, which has been correspondingly elongated, may be affixed, bolted, riveted, or screwed onto this third baffle. That portion of the affixation, bolt, rivet, or screw that resides in the interior of the light housing is attached along the side of the socket and behind the face of the light bulb so that the affixation will not be seen when the housing is in place.

24 Claims, 12 Drawing Sheets

Section B-B

Section A–A
Prior Art

Section B-B

Section C-C

TRI-BAFFLE CEILING FIXTURE REFLECTOR INCLUDING SNAPPER ASSEMBLY

BACKGROUND OF THE INVENTION

1. Field of the Invention

The present invention relates generally to a lightbulb housing assembly in a ceiling fixture, and specifically relates to an improved lightbulb housing for ornamentation.

2. Description of the Prior Art

The present invention relates generally to a lightbulb housing affixed into a ceiling fixture.

A lightbulb is a well known apparatus for controlling the spread of light from a lightbulb to achieve a desired visual effect. One detraction from existing reflector assemblies is that it is possible to see certain means by which the reflector is attached to the ceiling fixture, which detracts from the visual appearance of the lightbulb assembly.

Referring to FIGS. 1 and 2, there is illustrated a conventional lightbulb reflector housing assembly 100*a* comprising a light bulb housing 10*a* and snapper connector assembly 8*a*. The housing 10*a* is composed of an outer outside ring 1*a*, an outer ring 2*a*, an upper baffle 3*a*, and a bottom baffle 5*a*. The snapper connector assembly 8*a* consists of a right side snapper supporter 8*a*1 and a pair of snapper connector 8*a*2, and a left side snapper supporter 8*a*3 and a pair of snapper connectors 8*a*4. As illustrated in FIG. 2, the bottom baffle 5*a* is hollow and generally frustum shaped with a bottom circumference 5*a*1 which is smaller than its upper circumference 5*a*2.

Referring to FIG. 2 there is illustrated connection of the right side snapper supporter 8*a*1 to the housing. The connection is made through a right side rivet 6*a*1 which connects the right side snapper strip 8*a*1 to upper baffle 3*a* at a location adjacent the upper circumference 5*a*2 of the frustum shaped bottom baffle 5*a*. The right side snapper strip 8*a*1 also has a hook 7*a*1 at its lowermost end which penetrates into the frustum shaped lower baffle 5*a* in a slot therein. The retention is therefore spring-like so that the connection is made through the penetrating hook 7*a*1 and the rivet 6*a*1. Similarly, the left side snapper supporter 8*a*3 is connected to the housing. The connection is made through a left side rivet 6*a*2 which connects the left side snapper strip 8*a*3 to upper baffle 3*a* at a location adjacent the upper circumference 5*a*2 of the frustum shaped bottom baffle 5*a*. The left side snapper strip 8*a*3 also has a hook 7*a*2 at its lowermost end which penetrates into the frustum shaped lower baffle 5*a* in a slot therein. The retention is therefore spring-like so that the connection is made through the penetrating hook 7*a*2 and the rivet 6*a*2.

It will be appreciated that ends of the right side rivet 6*a*1 and hook 7*a*1 and the left side rivet 6*a*2 and the hook 7*a*2 are visible on an inner surface of the housing 10*a*, as illustrated in FIG. 1 from a front view of the reflector housing 10*a*. Therefore, visibility of the ends of the rivets and hooks significantly detracts from the beauty of the reflector housing 10*a*.

There is a significant need to significantly improve the visual appearance of the reflector housing 10*a* while still retaining the structure of the retaining means to retain the lightbulb reflector housing with a ceiling fixture.

SUMMARY OF THE INVENTION

The present invention is an improvement in lightbulb housings and in particular to reflectors which improvement provides a barrier so that the unsightly attachment by which the reflector is connected to the canister of a ceiling fixture is hidden from view by either the lightbulb or by an intermediate middle reflector. The improvement is to create an extension or bottom baffle into which the fixture attachment is attached. In the prior art, the attachment was connected to a lower portion of the upper baffle and to a second baffle positioned below the upper primary baffle. The connection was visible through both baffles. With the present invention, an additional extension is provided which extends from the second baffle so that the attachment means is affixed to the wall of the extension bottom baffle which lies in the area of the socket receiving the lightbulb. As a result, the lightbulb and or the middle baffle conceal the unsightly attachment while the lightbulb can be open for viewing and not concealed by a lens.

It has been discovered, according to the present invention, that if a conventional two section baffle reflector is improved through the addition of a third bottom baffle which extends from the previously second and now middle baffle, then the means by which the reflector is attached to a ceiling fixture can be attached to the added bottom baffle which rests adjacent the socket receiving the lightbulb which extends into the reflector. As a result, the lightbulb, and/or the middle or second baffle will conceal the unsightly attachment. Therefore, the lightbulb can be viewed but the unsightly attachment is thereby hidden from view, thereby enhancing the beauty of the reflector.

It has further been discovered, according to the present invention, that the improvement can be used with any type of reflector having an upper baffle that has a wall surface comprising grooves throughout, has a smooth surface throughout, or has a surface which has grooves in a portion and a smooth section in a remaining portion.

It has additionally been discovered, according to the present invention, that the conventional attachment which comprises a snapper retainer which retains a pair of snapper connectors thereon are received by receiving means in the ceiling fixture. The conventional connector means can be attached to the wall of the lower baffle by conventional rivets and a hook end extending into the baffle wall, and these attachments are concealed by the present invention.

It is therefore an object of the present invention to improve a conventional two section baffle reflector through the addition of a third bottom baffle which extends from the previously second and now middle baffle so that the means by which the reflector is attached to a ceiling fixture can be attached to the added bottom baffle which rests adjacent the socket receiving the lightbulb which extends into the reflector. As a result, the lightbulb, and/or the middle or second baffle will conceal the unsightly attachment. Therefore, the lightbulb can be viewed but the unsightly attachment is thereby hidden from view, thereby enhancing the beauty of the reflector.

It is a further object of the present invention to provide an improvement which can be used with any type of reflector having an upper baffle that has a wall surface comprising grooves throughout, has a smooth surface throughout, or has a surface which has grooves in a portion and a smooth section in a remaining portion.

It is an additional object of the present invention to utilize a conventional attachment which comprises a snapper retainer which retains a pair of snapper connectors thereon which are received by receiving means in the ceiling fixture. The conventional connectors can be attached to the wall of the lower baffle by conventional rivets and a hook end extending into the baffle wall, and these attachments are concealed by the present invention.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improvement to eliminate the unsightly appearance of the hooks and rivets of the attaching means by which the reflector is attached to a ceiling fixture by providing a third extension baffle which retains the hooks and rivet and an intermediate rounded baffle which serves to conceal the hooks and rivets attached into the third extension baffle.

Figure 1:
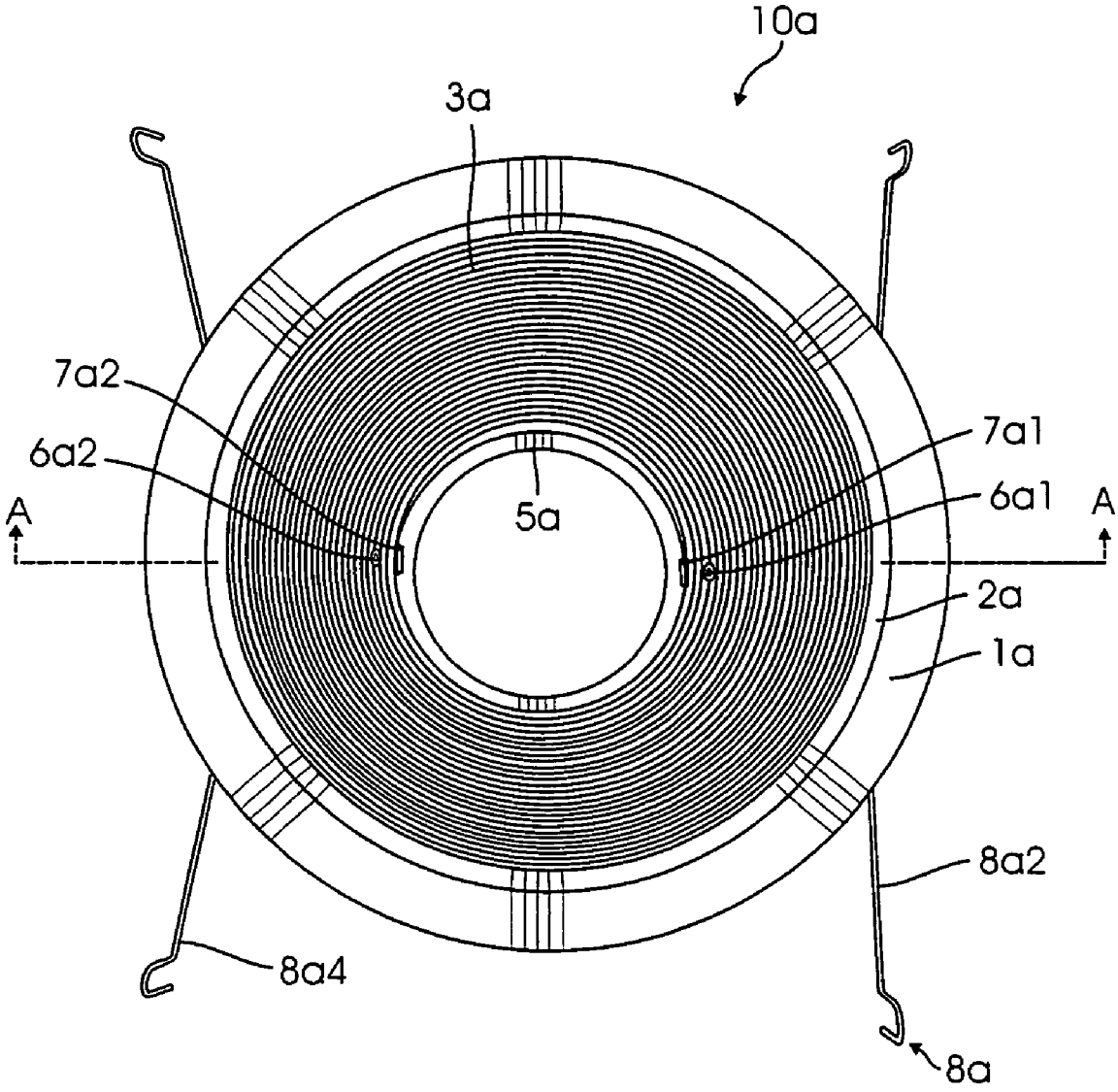
FIG. 1 Prior Art
FIG. 1 is a top view of a conventional lightbulb housing assembly known in the prior art.
Figure 2:
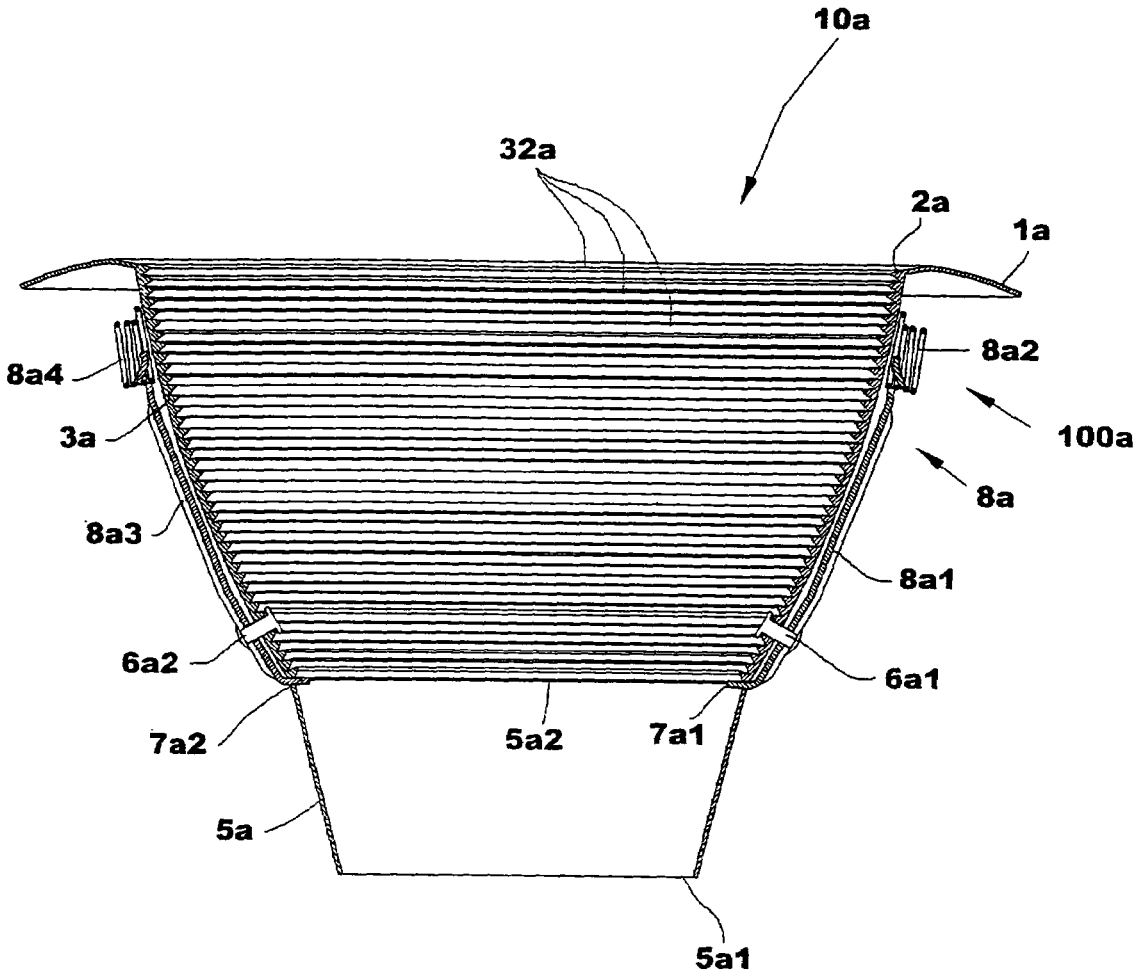
FIG. 2 is a cross-section view of the conventional lightbulb housing assembly taken along line A-A of the housing depicted in FIG. 1.
Figure 3A:
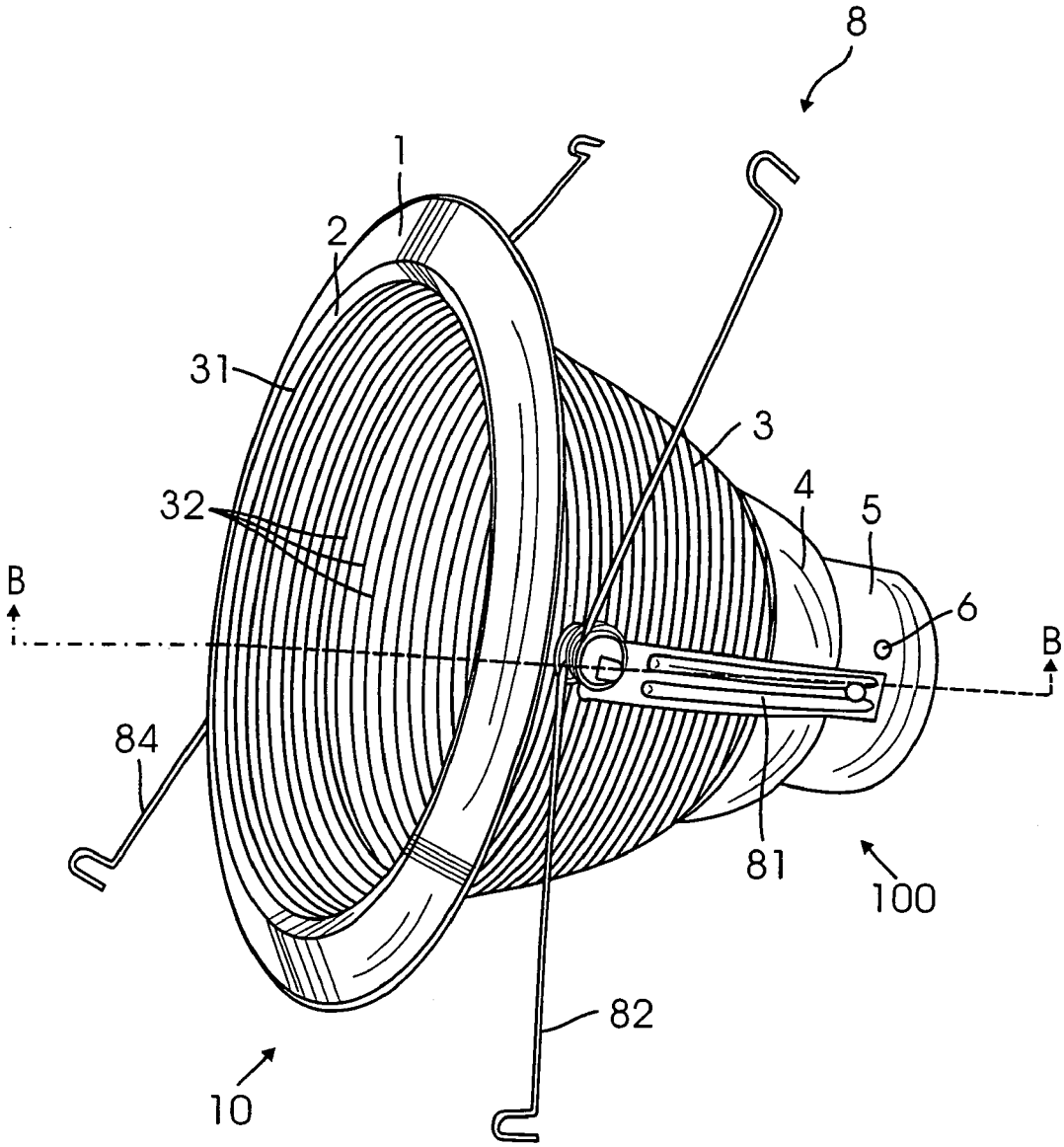
FIG. 3A is a perspective view of one embodiment of the present invention having grooves or baffles on the entire surface of the upper baffle of the reflector housing and including the improvement of the present invention to conceal the means by which the reflector is attached to a ceiling fixture.
Figure 3B:
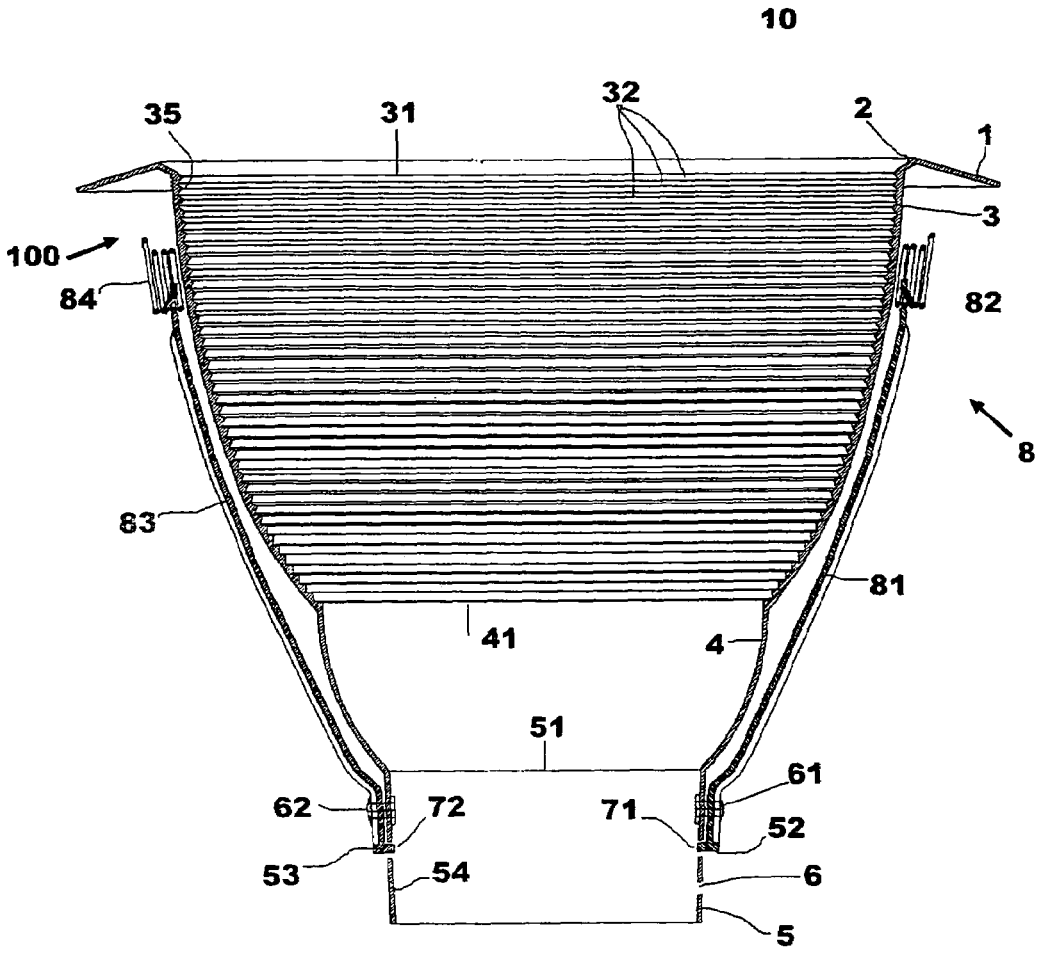
FIG. 3B is a cross-sectional view of one embodiment of the present invention taken along line B-B of FIG. 3A.
Figure 3C:
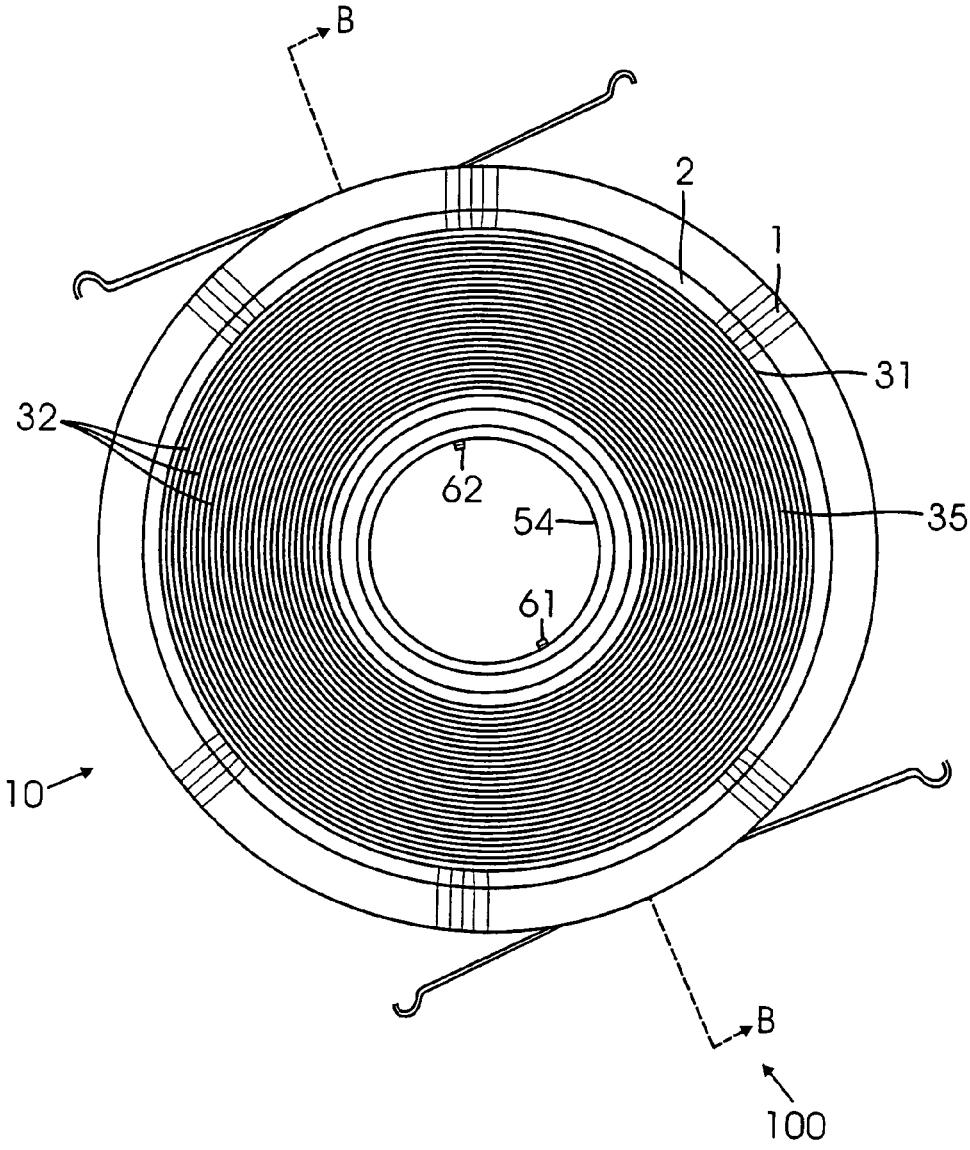
FIG. 3C is a top plan view of one embodiment of the present invention illustrated in FIG. 3A.

Referring to FIGS. 3A, 3B and 3C there are respectively illustrated a perspective, cross-sectional and top plan view of a first embodiment of the present invention having grooves or baffles on the entire surface of the upper baffle section of the reflector housing and including the improvement of the present invention to conceal the means by which the reflector is attached to a ceiling fixture.

The lightbulb 100 comprises a lightbulb housing or reflector 10 and a retaining means or snapper assembly 8. The reflector 10 has an outer circumferential ornamental ring 1, an optional upper circumferential ring 2, and three wall or baffle sections which includes a standard upper baffle 3, an added middle or rounded baffle 4 and a lower generally cylindrical bottom baffle 5, all of which are connected together to form a one piece structure where the upper baffle 3 extends to and is connected to the middle or rounded baffle 4 and the middle or rounded baffle 4 extends to and is connected to the bottom baffle 5. The middle or rounded baffle has an upper circumference 41 which is greater than its lower circumference 51 where it connects to the bottom extended baffle 5.

The means by which the reflector is retained within a ceiling fixture comprises a pair of oppositely disposed snapper supporters which are respectively attached to a pair of spring-like snapper connectors. Referring to FIGS. 3A, 3B and 3C, right snapper supporter 81 is attached to a pair, of oppositely disposed spring-like snapper connectors 82 and left snapper supporter 83 is attached to a pair of oppositely disposed spring-like snapper connectors 84. The right snapper supporter 81 is retained on reflector housing 10 by an attaching means which includes a rivet 61 and a penetrating hook 52 at the end of the bottom of the right snapper supporter 81. The innovation of the present invention is to create the lower extended bottom baffle 5 so that the rivet 61 extends into the wall of the bottom baffle at a location below the bottom of intermediate or middle rounded baffle 4 and the penetrating hook 71 extends into an opening 52 in the wall of the extended lower baffle 5 at a location below the rivet 61.

Similarly, the left snapper supporter 83 is retained on reflector housing 10 by an attaching means which includes a rivet 62 and a penetrating hook 72 at the end of the bottom of the right snapper supporter 81. The innovation of the present invention is to create the lower extended bottom baffle 5 so that the rivet 62 extends into the wall of the bottom baffle at a location below the bottom of intermediate or middle rounded baffle 4 and the penetrating hook 72 extends into an opening 53 in the wall of the extended lower baffle 5 at a location below the rivet 62.

As a result, the rivets 61 and 62 and the penetrating retaining hooks 71 and 72 which ordinarily would be seen in the prior art reflectors are concealed by the intermediate rounded baffle 4 and/or the lightbulb which extends into the reflector.

In the embodiment illustrated in FIGS. 3A through 3C, the wall of the upper baffle 3 contains a multiplicity of circumferential grooves 32 also known as baffles which extend from an upper circumference 31 of the upper baffle 3 at a location adjacent the upper circumferential ring 2 to the bottom of the upper baffle where it joins the top circumference 41 of the middle baffle 4.

Figure 4A:
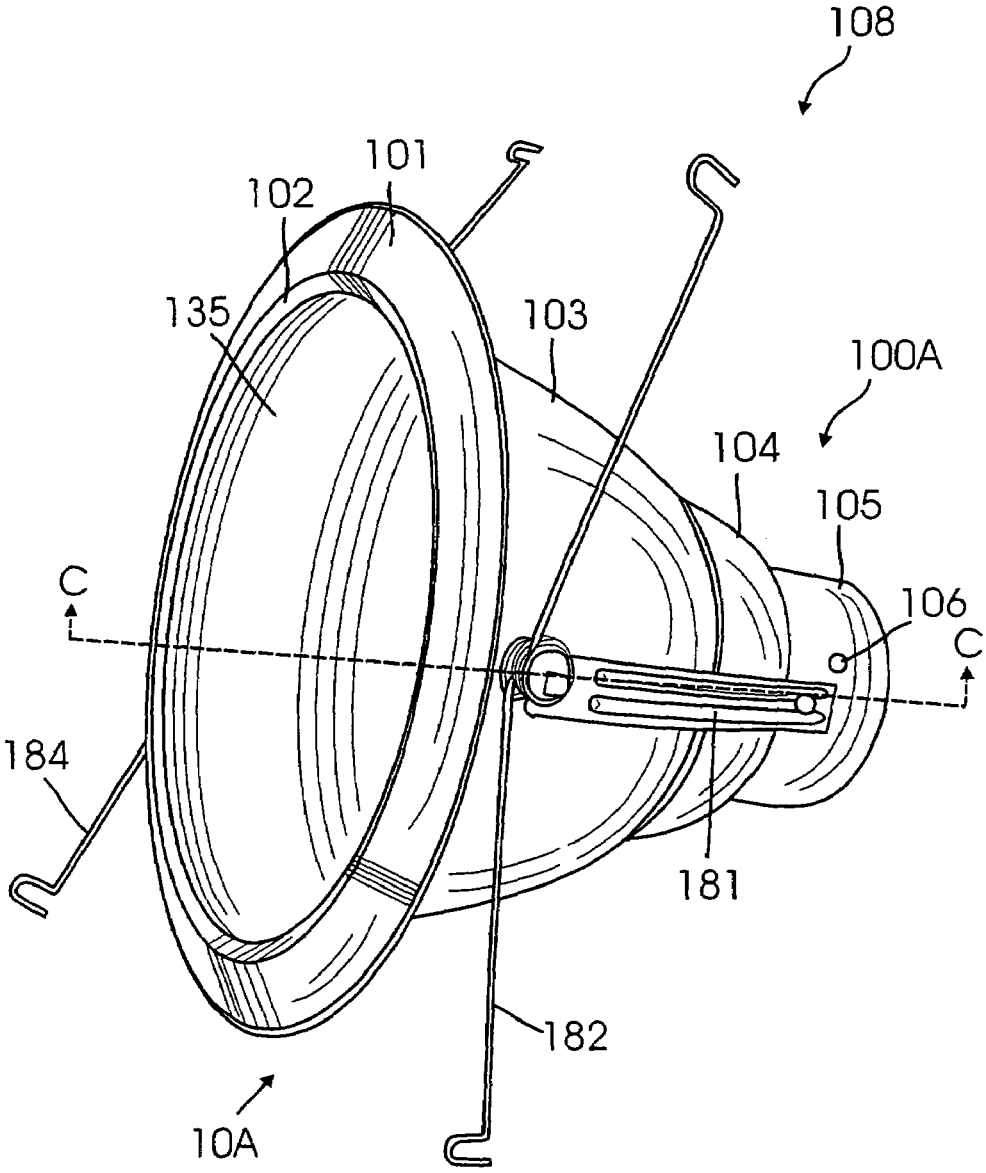
FIG. 4A is a perspective view of a second embodiment of the present invention having a smooth surface on the entire surface of the upper baffle of the reflector housing and including the improvement of the present invention to conceal the means by which the reflector is attached to a ceiling fixture.
Figure 4B:
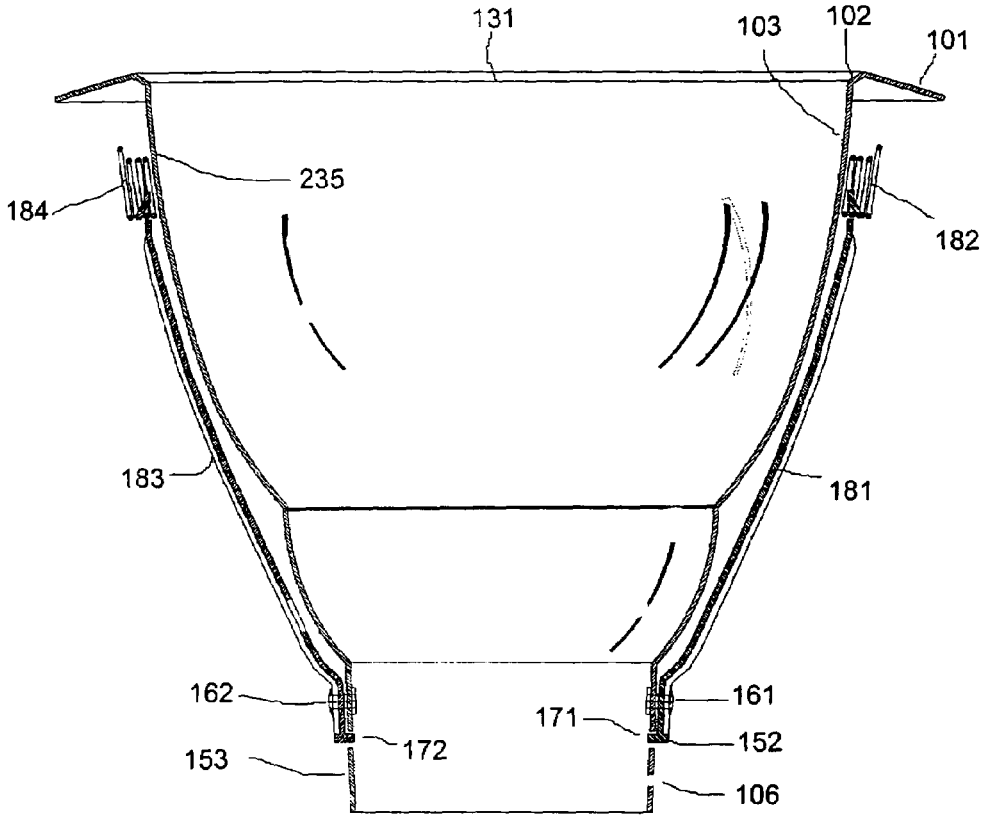
FIG. 4B is a cross-sectional view of the second embodiment of the present invention taken along line C-C of FIG. 4A.

Referring to FIGS. 4A and 4B there are respectively illustrated a perspective and cross-sectional view of the second embodiment of the present invention having a smooth surface on the entire surface of the upper baffle section of the reflector housing and including the improvement of the present invention to conceal the means by which the reflector is attached to a ceiling fixture.

The lightbulb assembly 100A comprises a lightbulb housing or reflector 10A and a retaining means or snapper assembly 108. The reflector 10A has an outer circumferential ornamental ring 101, an optional upper circumferential ring 102, and three wall or baffle sections which includes a standard upper baffle 103, an added middle or rounded baffle 104 and a lower generally cylindrical bottom baffle 105, all of which are connected together to form a one piece structure where the upper baffle 103 extends to and is connected to the middle or rounded baffle 104 and the middle or rounded baffle 104 extends to and is connected to the bottom baffle 105. The middle or rounded baffle has an upper circumference 141 which is greater than its lower circumference 151 where it connects to the bottom extended baffle 105.

The means by which the reflector is retained within a ceiling fixture comprises a pair of oppositely disposed snapper supporters which are respectively attached to a pair of spring-like snapper connectors. Referring to FIGS. 4A and 4B, right snapper supporter 181 is attached to a pair of oppositely disposed spring-like snapper connectors 182 and left snapper supporter 183 is attached to a pair of oppositely disposed spring-like snapper connectors 184. The right snapper supporter 181 is retained on reflector housing 10A by an attaching means which includes a rivet 161 and a penetrating hook 171 at the end of the bottom of the right snapper supporter 181. The innovation of the present invention is to create the lower extended bottom baffle 105 so that the rivet 161 extends into the wall of the bottom baffle at a location below the bottom of intermediate or middle rounded baffle 104 and the penetrating hook 171 extends into an opening 152 in the wall of the extended lower baffle 105 at a location below the rivet 161.

Similarly, the left snapper supporter 183 is retained on reflector housing 10A by an attaching means which includes a rivet 162 and a penetrating hook 172 at the end of the bottom of the right snapper supporter 181. The innovation of the present invention is to create the lower extended bottom baffle 105 so that the rivet 162 extends into the wall of the bottom baffle at a location below the bottom of intermediate or middle rounded baffle 104 and the penetrating hook 172 extends into an opening 153 in the wall of the extended lower baffle 105 at a location below the rivet 162.

As a result, the rivets 161 and 162 and the penetrating retaining hooks 171 and 172 which ordinarily would be seen in the prior art reflectors are concealed by the intermediate rounded baffle 104 and/or by the lightbulb which extends into the reflector.

In the embodiment illustrated in FIGS. 4A and 4B, the wall of the upper baffle 103 is smooth for the entire area which extends from an upper circumference 131 of the upper baffle 103 at a location adjacent the upper circumferential ring 102 to the bottom of the upper baffle where it joins the top circumference 141 of the middle baffle 104.

Figure 5A:
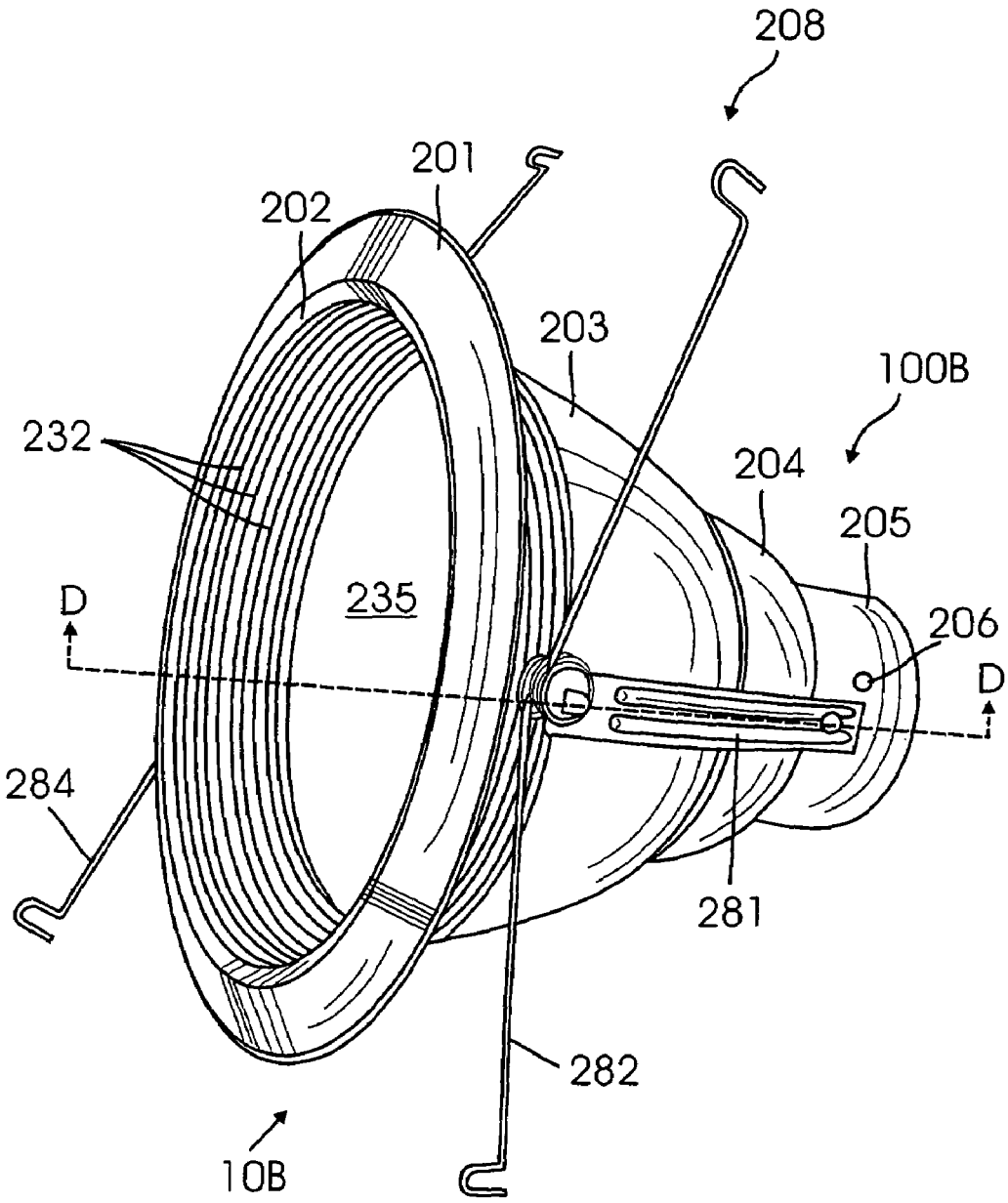
FIG. 5A is a perspective view of a third embodiment of the present invention having a reflector surface where a portion of the surface of the upper baffle has grooves or baffles and the remaining portion of the surface is smooth, the reflector housing including the improvement of the present invention to conceal the means by which the reflector is attached to a ceiling fixture.
Figure 5B:
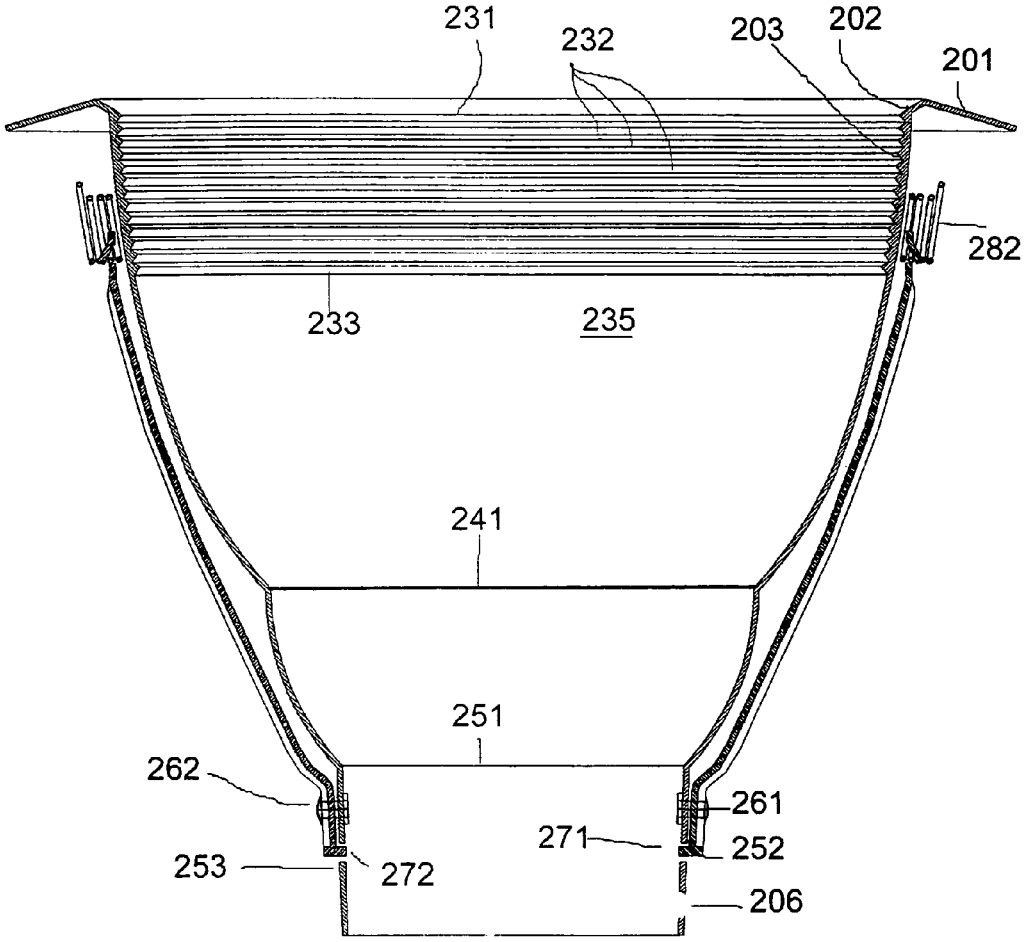
FIG. 5B is a cross-sectional view of the third embodiment of the present invention taken along line D-D of FIG. 5A.

Referring to FIGS. 5A and 5B there are respectively illustrated a perspective and cross-sectional view of the third embodiment of the present invention having a combination of a reflector surface which has grooves or baffles for a portion of the surface and is smooth for the remainder of the surface of the upper baffle, including the improvement of the present invention to conceal the means by which the reflector is attached to a ceiling fixture.

The lightbulb assembly 100B comprises a lightbulb housing or reflector 10B and a retaining means or snapper assembly 208. The reflector 10B has an outer circumferential ornamental ring 201, an optional upper circumferential ring 202, and three wall or baffle sections which includes a standard upper baffle 203, an added middle or rounded baffle 204 and a lower generally cylindrical bottom baffle 205, all of which are connected together to form a one piece structure where the upper baffle 203 extends to and is connected to the middle or rounded baffle 204 and the middle or rounded baffle 204 extends to and is connected to the bottom baffle 205. The middle or rounded baffle has an upper circumference 241 which is greater than its lower circumference 251 where it connects to the bottom extended baffle 205.

The means by which the reflector is retained within a ceiling fixture comprises a pair of oppositely disposed snapper supporters which are respectively attached to a pair of spring-like snapper retainers. Referring to FIGS. 5A and 5B, right snapper supporter 281 is attached to a pair of oppositely disposed spring-like snapper connectors 282 and left snapper supporter 283 is attached to a pair of oppositely disposed spring-like snapper connectors 284. The right snapper supporter 281 is retained on reflector housing 10B by an attaching means which includes a rivet 261 and a penetrating hook 271 at the end of the bottom of the right snapper supporter 281. The innovation of the present invention is to create the lower extended bottom baffle 205 so that the rivet 261 extends into the wall of the bottom baffle at a location below the bottom of intermediate or middle rounded baffle 204 and the penetrating hook 271 extends into an opening 252 in the wall of the extended lower baffle 205 at a location below the rivet 261.

Similarly, the left snapper supporter 283 is retained on reflector housing 10B by an attaching means which includes a rivet 262 and a penetrating hook 272 at the end of the bottom of the right snapper supporter 281. The innovation of the present invention is to create the lower extended bottom baffle 205 so that the rivet 262 extends into the wall of the bottom baffle at a location below the bottom of intermediate or middle rounded baffle 204 and the penetrating hook 272 extends into an opening 253 in the wall of the extended lower baffle 205 at a location below the rivet 262.

As a result, the rivets 261 and 262 and the penetrating retaining hooks 271 and 272 which ordinarily would be seen in the prior art reflectors are concealed by the intermediate rounded baffle 204 and/or the lightbulb which extends into the reflector.

In the embodiment illustrated in FIGS. 5A and 5B, the wall of the upper baffle 203 has grooves or baffles 232 for a portion of wall extending from the upper outer circumferential ring 202 to an interior location 233 on the wall and the wall portion 235 from location 233 to the bottom the upper baffle 203 where it connects to the top circumference 241 of middle or rounded baffle 204 is smooth.

Figure 6:
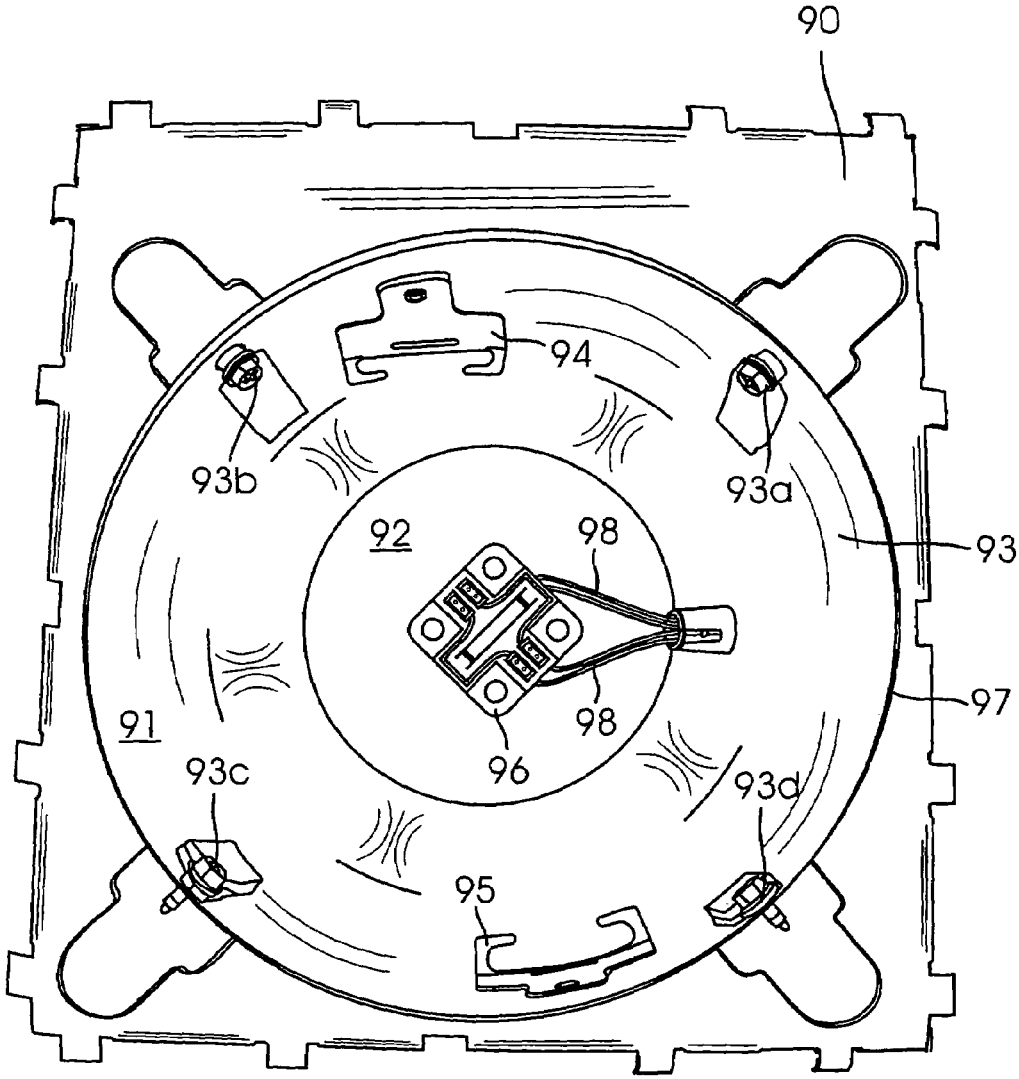
FIG. 6 is a top plan view of a ceiling fixture including a canister to which the present invention improved lightbulb assembly is attached.

Referring to FIG. 6, there is illustrated canister 91 which is transversely affixed into the ceiling plate 90 of a conventional ceiling fixture. The canister 91 is used to retain the reflector. As illustrated in FIG. 6, the canister 91 is transversely affixed into the ceiling plate 90, wherein the cylindrical canister 91 at its top circumference 97 is inserted into a central hole of the ceiling plate, and affixed to the plate through four screws 93*a*, 93*b*, 93*c* and 93*d*. The cylindrical canister further comprises a flatted bottom 92, where an electric socket 96 is installed at a center location of the bottom 92. The socket receives a lightbulb. Wires 98 from the socket can pass through at least one opening 6, 106 or 206 is a respective bottom baffle of each embodiment/ The interior 93 of the canister 91 further comprises a pair of oppositely disposed snapper retainer members 94 and 95 which are affixed to the interior wall of the canister 91 so that when the respective snapper connectors are respectively inserted into a snapper retainer, the reflector is retained within the canister so that the bottom of the bottom baffle lies flush against the flat bottom wall 92 of the canister.

Figure 7A:
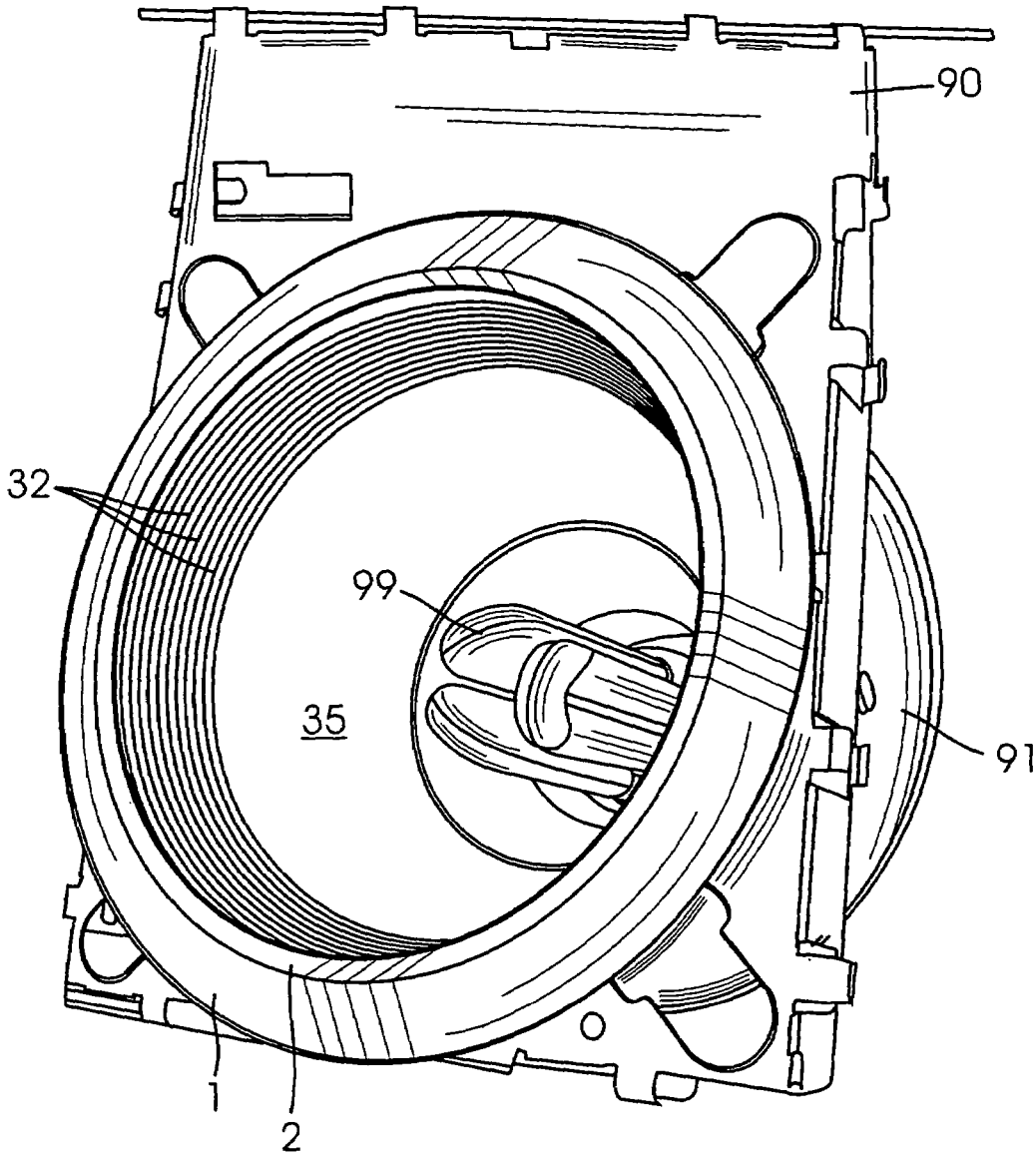
FIG. 7A is a perspective view showing the third embodiment of the present invention reflector with the improvement of the present invention retaining the connecting means by which the reflector is attached to a ceiling fixture so that the connecting means is concealed.
Figure 7B:
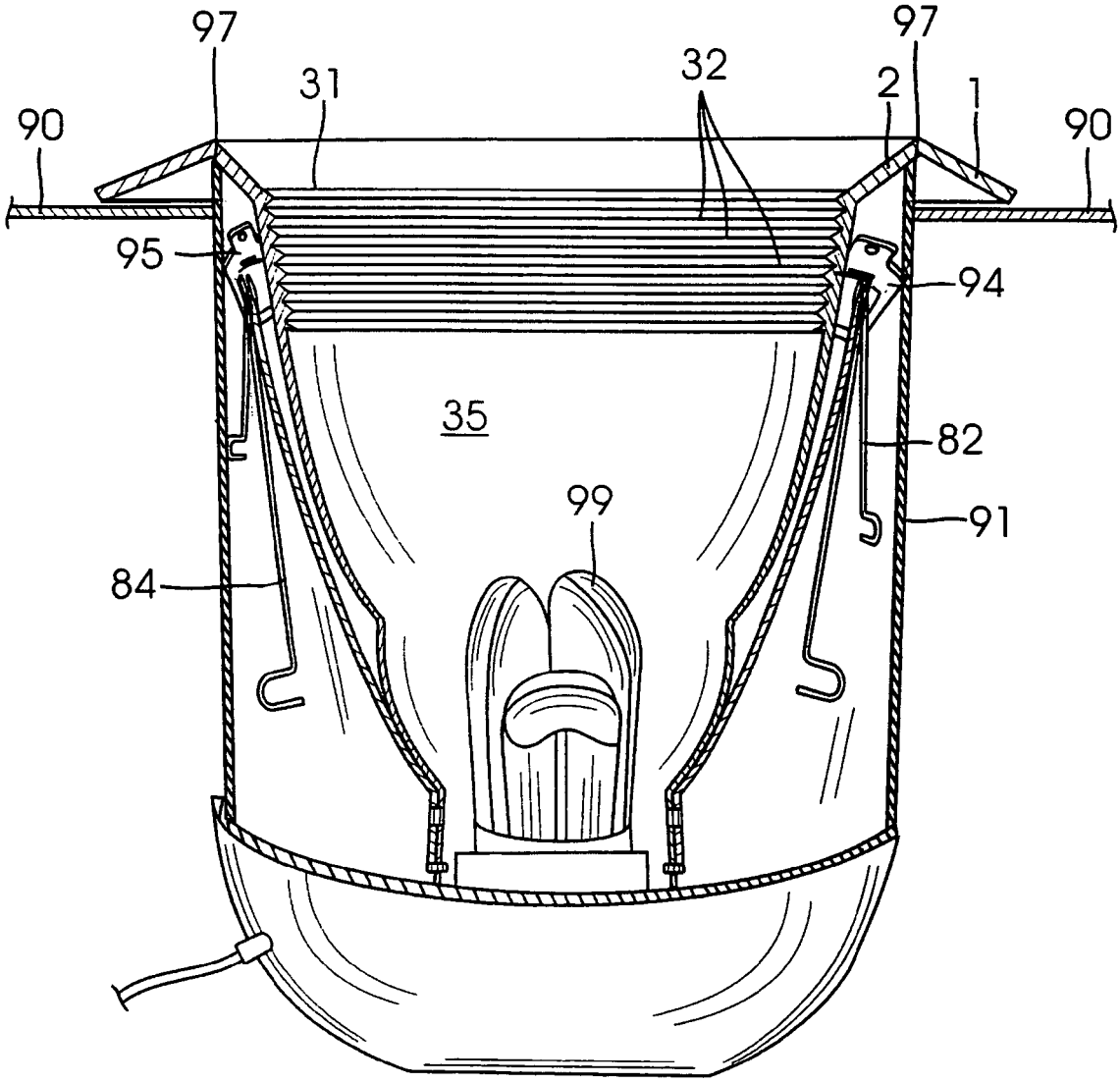
FIG. 7B is a cross-sectional view showing the third embodiment of the present invention reflector with the improvement of the present invention retaining the connecting means by which the reflector is attached to a ceiling fixture so that the connecting means is concealed.

Referring to FIGS. 7A and 7B, the third embodiment 10B of the reflector is illustrated which has a wall with grooves extending for a portion of the wall while the remainder of the surface is smooth. A lightbulb 99 is received within the socket 96 and is visible from the reflector 10B. The lightbulb 99 illustrated is a plug in fluorescent lightbulb but it will be appreciated that any standard incandescent lightbulb including a spot or flood lightbulb can also be used with the present invention. The critical feature and innovation is that the connecting means which are the rivets and the hooks at the ends of the snapper supports are not visible in the interior surface of the reflector because they are located in the extended lower bottom baffle and are hidden from view by the lightbulb body and by a portion of the middle or rounded baffle. As a result, the lightbulb can be seen but the unattractive attaching means is hidden from view, thereby enhancing the beauty of the reflector. The bottom baffle can also have at least one opening to enable the wires 98 from the socket 96 to extend through the bottom baffle for an electrical connection.

For all of the embodiments, the upper, middle and bottom baffles are hollow and are aligned so that their respective center-lines are aligned and are symmetrical about the center-line.

Defined in detail, the present invention is an improved reflector for use with a ceiling fixture having a canister containing a socket assembly for a lightbulb, the canister having a pair of oppositely disposed snapper retainers, the improved reflector comprising: (a) an upper generally hollow baffle extending into a middle generally rounded hollow baffle which extends into an extended bottom hollow baffle having a wall with a bottom end, the baffles aligned so that their respective center-lines are aligned and are symmetrical about the center-line; (b) a pair of oppositely disposed snapper assemblies, each snapper assembly having a snapper retainer having a hook at one end, each snapper retainer attached at oppositely disposed locations on the bottom baffle wall by a rivet extending through the snapper retainer and into the wall of the bottom baffle and the hook extending through an opening in the bottom baffle wall at a location between the location of the rivet and the bottom end of the bottom baffle wall, each snapper retainer supporting a pair of snapper connectors; and (c) the reflector retained within the canister by a respective snapper connector received within a respective snapper retainer in the canister so that the lightbulb socket is positioned within the bottom baffle and a lightbulb is received within and retained within the lightbulb socket and extends into the reflector so that the lightbulb extends through the bottom baffle, the middle rounded baffle and at least a portion of the upper baffle so that the lightbulb is visible but the rivets and hooks are concealed by the lightbulb and a portion of the middle rounded baffle.

Defined more broadly, the present invention is an improved reflector for use with a ceiling fixture having a canister containing a socket assembly for a lightbulb, the canister having a pair of oppositely disposed snapper retainers, the improved reflector comprising: (a) a upper generally hollow baffle extending into a middle generally hollow baffle which extends into an extended bottom hollow baffle having a wall with a bottom end; (b) a pair of oppositely disposed snapper assemblies, each snapper assembly having a snapper retainer having attaching means by which the snapper retainer is affixed into the wall of the bottom baffle, each snapper retainer supporting a pair of snapper connectors; and (c) the reflector retained within the canister by a respective snapper connector received within a respective snapper retainer in the canister so that the lightbulb socket is positioned within the bottom baffle and a lightbulb is received within and retained within the lightbulb socket and extends into the reflector so that the lightbulb extends through the bottom baffle, the middle baffle and at least a portion of the upper baffle so that the lightbulb is visible but the means by which the snapper retainers are affixed to the wall of the bottom baffle are concealed by the lightbulb and a portion of the middle baffle.

Defined even more broadly, the present invention is an improved reflector for use with a ceiling fixture having a canister containing a socket assembly for a lightbulb, the canister having a pair of oppositely disposed retaining members, the improved reflector comprising: (a) a upper generally hollow baffle extending into a middle generally hollow baffle which extends into an extended bottom hollow baffle having a wall with a bottom end; (b) a pair of oppositely disposed connector assemblies, each connector assembly having a connector retainer having attaching means by which the connector retainer is affixed into the wall of the bottom baffle, each connector retainer supporting a connector; and (c) the reflector retained within the canister by a respective connector received within a respective connector retainer in the canister so that the lightbulb socket is positioned within the bottom baffle and a lightbulb is received within and retained within the lightbulb socket and extends into the reflector so that the lightbulb extends through the bottom baffle, the middle baffle and at least a portion of the upper baffle so that the lightbulb is visible but the means by which the snapper connector retainers are affixed to the wall of the bottom baffle are concealed by the lightbulb.

Defined most broadly, the present invention is, an improved reflector for use with a ceiling fixture having a canister containing a socket assembly for a lightbulb, the canister having at last one retaining member, the improved reflector comprising: (a) an upper generally hollow baffle extending into at least one second baffle assembly having an elongated bottom portion having a wall with a bottom end; (b) at least one connector assembly having a connector retainer having attaching means by which the connector retainer is affixed into the wall of the elongated bottom portion, the at least one connector retainer supporting a connector; and (c) the reflector retained within the canister by the connector received within said at last one connector retainer in the canister so that the lightbulb socket is positioned within the bottom baffle and a lightbulb is received within and retained within the lightbulb socket and extends into the reflector so that the lightbulb extends through the reflector to at least a portion of the upper baffle, so that the lightbulb is visible but the means by which the connector retainer is affixed to the wall of the elongated bottom portion is concealed by the lightbulb.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An improved reflector for use with a ceiling fixture having a canister containing a socket assembly for a lightbulb, the lightbulb socket having an upper end, the canister having a pair of oppositely disposed retaining members, the improved reflector comprising:

a. an upper generally hollow baffle extending into a middle generally hollow baffle which extends into an extended bottom hollow baffle having a wall with a bottom end, the upper baffle adjacent a trim;

b. a pair of oppositely disposed connector assemblies, each connector assembly having a connector retainer having attaching means by which the connector retainer is affixed into the wall of the bottom baffle, each connector retainer supporting a connector; and c. the reflector retaining itself within the canister by a respective connector retainer received within a respective connector retainer in the canister so that the lightbulb socket is positioned entirely within the bottom baffle to conceal the means by which each snapper is affixed into the wall of the bottom baffle, and wherein the middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein.

2. A reflector in accordance with claim 1 wherein the upper baffle has a top which extends into an ornamental upper ring.

3. A reflector in accordance with claim 1 wherein said upper baffle has a wall further comprising a multiplicity of circumferential grooves within the wall extending for the entire upper baffle from a location adjacent a top of the upper baffle to a location adjacent the middle baffle.

4. A reflector in accordance with claim 1 wherein said upper baffle has a wall further comprising a smooth surface for the entire upper baffle extending from a location adjacent a top of the upper baffle to a location adjacent the middle baffle.

5. A reflector in accordance with claim 1 wherein said upper baffle has a wall further comprising a multiplicity of circumferential grooves within the wall extending for a portion of the upper baffle from a location adjacent a top of the upper baffle to a location between the top and where the upper baffle connects to the middle baffle, and the wall is smooth from the location of the circumferential groove to a location adjacent the middle baffle.

6. A reflector in accordance with claim 1 wherein the wall of said bottom baffle further comprises at least one opening to permit wires from said socket to extend through said at least one opening.

7. An improved reflector for use with a ceiling fixture having a canister containing a socket assembly for a lightbulb, the canister having a pair of oppositely disposed snapper retainers, the lightbulb socket having an upper end, the improved reflector comprising:

a. a upper generally hollow baffle extending into a middle generally hollow baffle which extends into an extended bottom hollow baffle having a wall with a bottom end, the upper baffle having a trim;

b. a pair of oppositely disposed snapper assemblies, each snapper assembly having a snapper retainer having attaching means by which the snapper retainer is affixed into the wall of the bottom baffle, each snapper retainer supporting a pair of snapper connectors; and c. the reflector retaining itself within the canister by a respective snapper connector received within a respective snapper retainer in the canister so that the lightbulb socket is positioned entirely within the bottom baffle to conceal the means by which each snapper is affixed into the wall of the bottom baffle, and the middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein.

8. A reflector in accordance with claim 7 wherein the upper baffle has a top which extends into an ornamental upper ring.

9. A reflector in accordance with claim 7 wherein said upper baffle has a wall further comprising a multiplicity of circumferential grooves within the wall extending for the entire upper baffle from a location adjacent a top of the upper baffle to a location adjacent the middle baffle.

10. A reflector in accordance with claim 7 wherein said upper baffle has a wall further comprising a smooth surface for the entire upper baffle extending from a location adjacent a top of the upper baffle to a location adjacent the middle baffle.

11. A reflector in accordance with claim 7 wherein said upper baffle has a wall further comprising a multiplicity of circumferential grooves within the wall extending for a portion of the upper baffle from a location adjacent a top of the upper baffle to a location between the top and where the upper baffle connects to the middle baffle, and the wall is smooth from the location of the circumferential groove to a location adjacent the middle baffle.

12. A reflector in accordance with claim 7 wherein the wall of said bottom baffle further comprises at least one opening to permit wires from said socket to extend through said at least one opening.

13. An improved reflector for use with a ceiling fixture having a canister containing a socket assembly for a lightbulb, the lightbulb socket having an upper end, the canister having at last one retaining member, the improved reflector comprising:

a. an upper generally hollow baffle extending into at least one second baffle assembly having an elongated bottom portion having a wall with a bottom end, the upper baffle adjacent a trim;

b. at least one connector assembly having a connector retainer having attaching means by which the connector retainer is affixed into the wall of the elongated bottom portion, the at least one connector retainer supporting a connector; and c. the reflector retaining itself within the canister by a connector retainer received within a connector retainer in the canister so that the lightbulb socket is positioned entirely within the bottom baffle to conceal the attaching means by which the connector retainer is affixed into the wall of the elongated bottom portion, and the upper baffle ending and the second baffle beginning at a point approximately near the upper end of the lightbulb socket, the bottom baffle extending backwardly away from the trim, the bottom baffle having a hole through which connecting electrical wires may reach and interconnect with the lightbulb socket residing therein.

14. A reflector in accordance with claim 13 wherein the upper baffle has a top which extends into an ornamental upper ring.

15. A reflector in accordance with claim 13 wherein said upper baffle has a wall further comprising a multiplicity of circumferential grooves within the wall extending for the entire upper baffle from a location adjacent a top of the upper baffle to a location adjacent the at least one second baffle assembly.

16. A reflector in accordance with claim 13 wherein said upper baffle has a wall further comprising a smooth surface for the entire upper baffle extending from a location adjacent a top of the upper baffle to a location adjacent the at least one second baffle assembly.

17. A reflector in accordance with claim 13 wherein said upper baffle has a wall further comprising a multiplicity of circumferential grooves within the wall extending for a portion of the upper baffle from a location adjacent a top of the upper baffle to a location between the top and where the upper baffle connects to the at least one second baffle assembly, and the wall is smooth from the location of the circumferential groove to a location adjacent the at least one second baffle assembly.

18. A reflector in accordance with claim 13 wherein the wall of said extended portion further comprises at least one opening to permit wires from said socket to extend through said at least one opening.

19. An improved reflector for use with a ceiling fixture having a canister containing a socket assembly for a lightbulb, the lightbulb socket having an upper end, the canister having a pair of oppositely disposed snapper retainers, the improved reflector comprising:

a. an upper generally hollow baffle extending into a middle generally rounded hollow baffle which extends into an extended bottom hollow baffle having a wall with a bottom end, the baffles aligned so that their respective center-lines are aligned and are symmetrical about the center-line, the upper baffle adjacent a trim;

b. a pair of oppositely disposed snapper assemblies, each snapper assembly having a snapper retainer having a hook at one end, each snapper retainer attached at oppositely disposed locations on the bottom baffle wall by a rivet extending through the snapper retainer and into the wall of the bottom baffle and the hook extending through an opening in the bottom baffle wall at a location between the location of the rivet and the bottom end of the bottom baffle wall, each snapper retainer supporting a pair of snapper connectors; and c. the reflector retaining itself within the canister by a respective snapper connector received within a respective snapper retainer in the canister so that the lightbulb socket is positioned entirely within the bottom baffle to conceal each rivet of a snapper assembly, and the middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein.

20. A reflector in accordance with claim 1 wherein the upper baffle has a top which extends into an ornamental upper ring.

21. A reflector in accordance with claim 1 wherein said upper baffle has a wall further comprising a multiplicity of circumferential grooves within the wall extending for the entire upper baffle from a location adjacent a top of the upper baffle to a location adjacent the middle baffle.

22. A reflector in accordance with claim 1 wherein said upper baffle has a wall further comprising a smooth surface for the entire upper baffle extending from a location adjacent a top of the upper baffle to a location adjacent the middle baffle.

23. A reflector in accordance with claim 1 wherein said upper baffle has a wall further comprising a multiplicity of circumferential grooves within the wall extending for a portion of the upper baffle from a location adjacent a top of the upper baffle to a location between the top and where the upper baffle connects to the middle baffle, and the wall is smooth from the location of the circumferential groove to a location adjacent the middle baffle.

24. A reflector in accordance with claim 1 wherein the wall of said bottom baffle further comprises at least one opening to permit wires from said socket to extend through said at least one opening.

* * * * *